United States Patent [19]

Judge et al.

[11] 4,012,845

[45] Mar. 22, 1977

[54] DEHYDRATION PROCESS

[75] Inventors: Francis John Judge, Rushden; Joseph Morriss Stubbs, Bedford, both of England

[73] Assignee: N.V. Internationale Octrooi Maatschappij "Octropa", Rotterdam, Netherlands

[22] Filed: Dec. 8, 1975

[21] Appl. No.: 638,258

[30] Foreign Application Priority Data

Dec. 16, 1974 United Kingdom ..... 54268/74

[52] U.S. Cl. ..... 34/9; 34/95

[51] Int. Cl.[2] ..... F26B 3/00; F26B 5/16

[58] Field of Search ..... 34/9, 95, 95.1, 10

[56] References Cited

UNITED STATES PATENTS

| | | | |
|---|---|---|---|
| 2,224,284 | 12/1940 | Barnett | 34/95 |
| 2,906,636 | 9/1959 | Hoivik | 34/9 X |
| 3,571,942 | 3/1971 | Orensten et al. | 34/9 |
| 3,577,647 | 5/1971 | Shimooka | 34/9 |
| 3,861,053 | 1/1975 | Rovetti | 34/9 |

*Primary Examiner*—John J. Camby
*Attorney, Agent, or Firm*—Barry Kramer

[57] ABSTRACT

Traditionally flowers are dried for decorative purposes by being left immersed in a bed of fine sand. The sand holds the flower in a constant conformation and prevents damage such as the crinkling of petals during dehydration. The invention provides a process in which the labor-intensive operation of covering the flower manually with the sand is avoided. The sand is fluidized by means of a gentle current of air rising therethrough, enabling the flower to be simply immersed in the sand without damage or change in conformation. Fluidization is stopped, and the flower is instantly locked in place by the sand ready for dehydration. After dehydration, the flower can be removed from the sand easily by re-fluidizing the sand.

9 Claims, 3 Drawing Figures

DEHYDRATION PROCESS

The present invention relates to the dehydration of delicate objects.

Delicate objects, such as flowers and other plant material that are used in the dry state for decorative purposes, are usually dehydrated while immersed in a dry particulate material such as fine sand or powdered silica gel. During the dehydration the dry particulate material holds the delicate object in a constant conformation and prevents undue distortion of the delicate object, for example the crinkling of petals or leaves. Overall, this procedure is very labour intensive because prior to the dehydration the delicate object must be carefully packed in the dry particulate material, and removal of the delicate object from the dry particulate material after dehydration must be conducted with equal care.

The invention provides a process for the dehydration of a delicate object, comprising the steps of:

a. inducing relative motion between particles in a bed of dry particulate material;

b. immersing the delicate object in the bed while maintaining the relative motion at least in a zone which encompasses the delicate object; and c. causing the relative motion to cease, so causing the particulate material to hold the delicate object in a constant conformation while dehydration of the delicate object is effected.

The desired relative motion within the bed of dry particulate material can be achieved in a variety of ways, for example by mechanical vibration of the bed or by the use of electrical forces. However we have found that an ideal way of inducing the relative motion is to fluidise the bed by means of an upward current of gas through the bed.

The dry particulate material can be any of those materials conventionally used in the drying of plant material. Suitable particulate materials include sand, silica gel and ion exchange resins. Fine sand, especially silver sand, is preferred.

When satisfactorily immersed in the dry particulate material, the delicate object can be dried in the normal manner. Although drying can be accomplished simply by leaving the delicate object immersed in the dry particulate material at ambient temperature for a number of days, we prefer to accelerate the drying procedure by maintaining the delicate object in the bed at an elevated temperature, for example 40°to 50° C. At such elevated temperatures plant material, for example, will be adequately dehydrated in a number of hours, for instance being left overnight.

After dehydration the delicate object can be removed from the bed in the conventional manner, ie by laborious and careful extraction. However, removal of the delicate object is considerably facilitated if use is again made of induced relative motion within the bed.

In the conventional production of dried plant material the dehydrated material after removal from the bed is preserved against atmospheric moisture and physical damage by being sprayed or otherwise coated with solidifiable materials such as resins or plastics. A dehydrated object prepared in accordance with the present invention can be further preserved in this way if desired.

By way of example only, an experimental demonstration of a preferred embodiment of the invention is now described with reference to the accompanying drawing, wherein.

Figure 1:
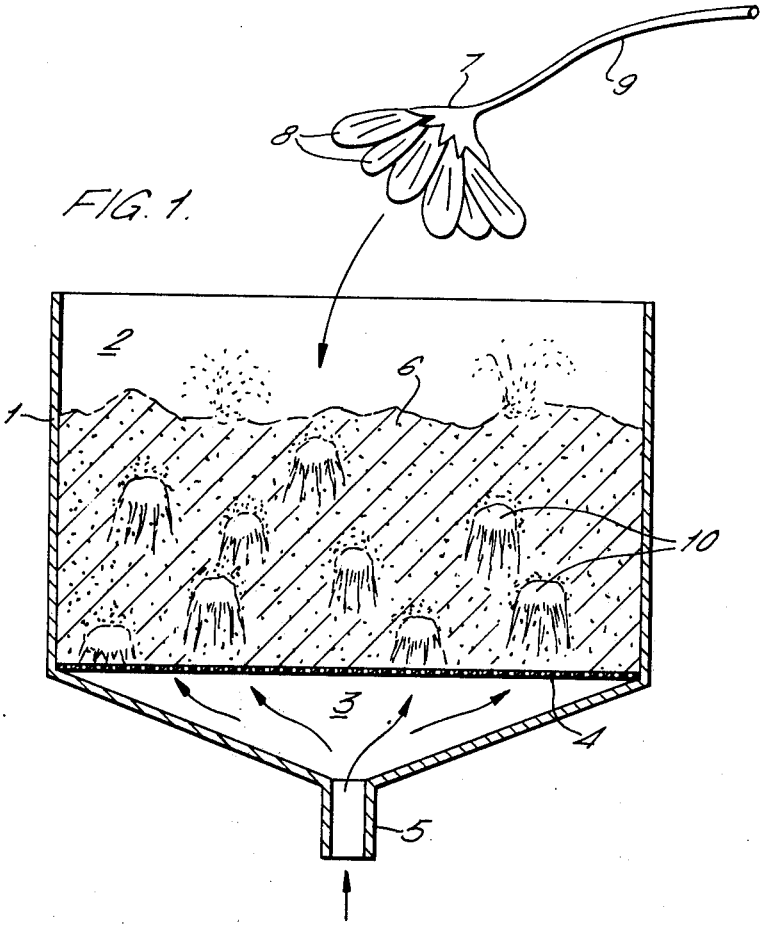
FIG. 1 represents in vertical section a bed of dry particulate material immediately prior to the immersion therein of a flower head.

Referring to FIG. 1, the simple experimental apparatus comprises a standard sintered glass funnel consisting of a glass body 1 having an upper cylindrical chamber 2, a lower frusto-conical chamber 3 separated from the upper chamber by a sintered glass disc 4, and an outlet pipe 5 extending from the bottom of the frustroconical chamber 3. The funnel 1 is held in an upright position by retaining means (not shown), and the outlet tube 5 is connected to a controllable supply of compressed air (also not shown). Upper chamber 2 is partially filled with a bed 6 of fine silver sand, and as depicted in FIG. 1 this bed of sand is in a state of fluidisation.

Figure 2:
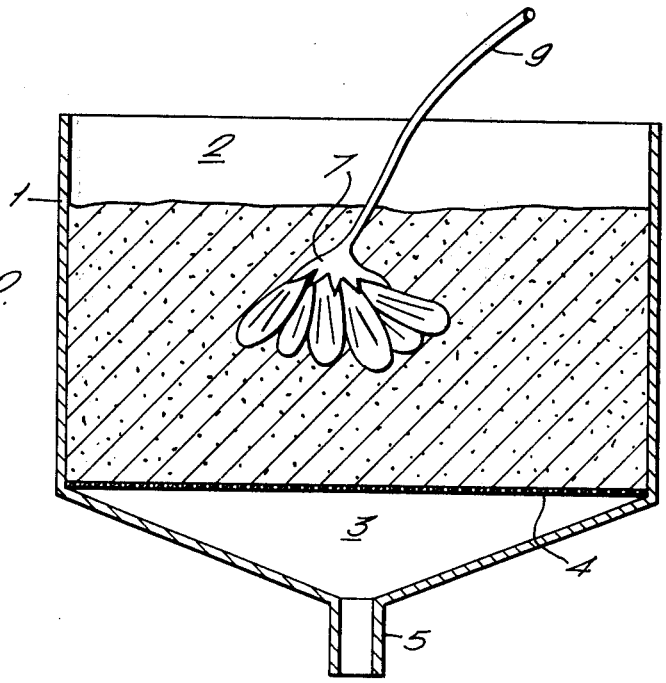
FIG. 2 represents in vertical section the same bed with the flower head immersed therein.

A flower head 7, comprising petals 8 and a stalk 9, is to be dehydrated using the process of the invention. The controllable air supply is switched on and a gentle current of air is fed upwards through the funnel 1. The air passes through the sintered glass disc 4, and then upwards through the bed 6 as small bubbles or pockets 10 whose passage maintains the sand in a constant state of agitation. While the sand is being fluidised, the flower head 7 is lowered into the bed. Because of the relative motion of the individual sand grains in the bed, the flower head can be immersed easily in the bed with minimal damage to the delicate petals 8 and without significant disruption of the natural conformation of the flower head. The stalk 9 is left partially exposed to facilitate later removal of the flower head from the bed. As soon as the flower head 7 has been suitable immersed in the sand, the air supply is shut off and the agitation of the sand grains immediately ceases. FIG. 2 depicts the situation that then exists, with the flower head 7 immersed in the sand and the petals held in a constant conformation by the static sand grains.

The funnel 1 and contents are disconnected from the air supply and left overnight in an oven maintained at a temperature of 45° C. The funnel is then removed from the oven and reconnected to the air supply, and the air turned on. By means of stalk 9 the flower head 7 is easily removed from the fluidised sand, and any residual sand adhering to the head can be removed by gently shaking the head. The flower head is found to be fully dehydrated, and the delicate petals 8 are still in their natural conformation and will not have been damaged either by the dehydration or by the immersion in the sand.

Figure 3:
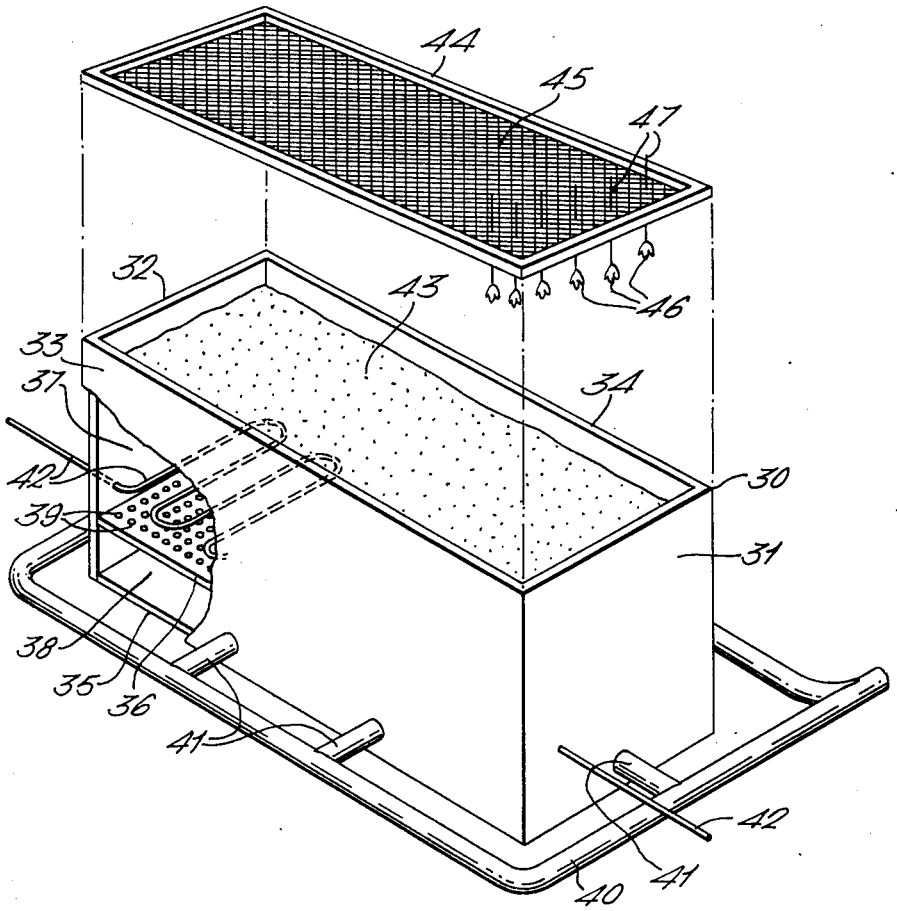
FIG. 3 represents a general isometric view of a production-scale dehydration unit for flowers, utilising the principle of the invention.

FIG. 3 shows a production scale flower drying unit utilising the principle of the invention as just described. The unit comprises an open-topped rectangular drying chamber 30 constructed from two vertical end walls 31 and 32, two vertical side walls 33 and 34 and a horizontal flat rectangular base 35. Wall 33 of drying chamber 30 is partially cut away to show the internal construction of the chamber. Drying chamber 30 is divided by a horizontal flat rectangular partition 36 into an upper open-topped chamber 37 and a lower totally enclosed chamber 38 of smaller vertical dimension than upper chamber 37. Partition 36 is perforated by a multitude of very small holes 39. An air duct 40 leading from a supply of pressurised air (not shown) runs around the drying chamber 30 and is inletted into the lower chamber 38 via a plurality of inlet pipes 41 of which only three can be seen in the drawing. The inlet pipes 41 are regularly spaced around the chamber 38 to permit a reasonably uniform flow of air into the chamber. A heating element 42 runs through the upper chamber 37 along a horizontal zig-zag path slightly above the level of partition 36. This heating element 42 can be a pipe carrying a heating liquid, such as hot water or hot oil, or alternatively heating element 42 can be of an electrical type. Upper chamber 37 contains a bed of sand 43 filling most of the chamber. The holes 39 in partition 36 will be either of sufficiently small diameter, or will be baffled, to prevent the sand falling into the lower chamber 38. The drying unit also comprises a removable flat rectangular frame 44 whose dimensions match those of the top of drying chamber 30. Across frame 44 is stretched a mesh 45, constructed from wire or other suitably tensile material.

In order to dehydrate flowers using this dehydrating unit, a plurality of flower heads 46 are suspended below the frame 44 in such a manner that when frame 44 is placed on top of drying unit 30 the flower heads will be below the level of the top of the bed of sand 43 in upper chamber 37. The flower heads can be suspended by means of their stalks if these are sufficiently long, or alternatively by other suspending means such as wires. The stalks or wires will be secured to the mesh 45 by, for example, being wired thereto or clipped thereon. The air supply is turned on, and pressurised air passes through duct 40 and inlet pipes 41 into chamber 38 from whence it escapes by passing through the perforations 39 in partition 36 and rising through and fluidising the bed of sand 43, the air flow being adjusted so that the sand is fluidised sufficiently to permit immersion of the flower heads but not so vigorously as to damage the flower heads. Frame 44 is lowered gently onto the top of drying chamber 30, and while this occurs the flower heads 46 are immersed in the fluidised sand. Upward passage of the air through the sand is unimpeded because the air can pass through the mesh 45. When the frame 44 is resting on top of drying chamber 30 the air supply is switched off and the flower heads dehydrated while firmly held in the sand, which is warmed by means of heating element 42. When, after a number of hours, the flowers are satisfactorily dehydrated the air supply is switched on again, so fluidising the sand and permitting frame 44 to be lifted away from chamber 30 releasing the flower heads from the sand. Any sand which adheres to the flower heads can be removed readily by gentle vibration of the frame.

While the dried flower heads are still attached to the mesh 45, the flower heads can be subjected to subsequent conventional processing operations, such as being sprayed with or dipped into a preserving liquid.

What we claim is:

1. A process for the dehydration of a delicate object such as plant material, which process involves the steps of:

a. inducing relative motion between particles in a bed of dry particulate material selected from fine sand, silica gel and ion exchange resins;

b. immersing said delicate object in said bed while maintaining said relative motion at least in a zone which encompasses said delicate object; and c. causing said relative motion to cease, so causing said particulate material to hold said delicate object in a constant conformation while dehydration of said delicate object is effected.

2. A process as claimed in claim 1, wherein removal of said delicate object from said bed after dehydration thereof is facilitated by further inducing relative motion between particles in said bed.

3. A process as claimed in claim 1, wherein said relative motion is induced by means of an upward current of gas through said bed.

4. A process as claimed in claim 1, wherein said particulate material is fine sand.

5. A process as claimed in claim 4 wherein said bed is maintained at a temperature of from 40° to 50° C while dehydration of said delicate object takes place.

6. A process as claimed in claim 5, wherein said delicate object is a flower head.

7. Apparatus for use in a process as claimed in claim 1 consisting essentially of containing means containing a bed of dry particulate material, means for fluidizing particulate material contained in said containing means, and means for holding a delicate object and lowering said delicate object so held into the fluidized bed of particulate material contained in said containing means.

8. Apparatus as claimed in claim 7, additionally comprising means for heating particulate material contained in said containing means.

9. Apparatus as claimed in claim 7, consisting essentially of an open-topped containing means containing a bed of particulate material, means for passing a current of gas upwards through the bed of particulate material contained in said containing means, a removable frame shaped to fit on the open top of said containing means, and a mesh supported on said frame.

* * * * *